US007985908B1

(12) United States Patent
Howard et al.

(10) Patent No.: US 7,985,908 B1
(45) Date of Patent: Jul. 26, 2011

(54) PRACTICE DRUM PAD ASSEMBLY AND RIM THEREFOR

(75) Inventors: Paul J. Howard, Vancouver, WA (US); David C. Lauder, Oregon City, OR (US)

(73) Assignee: Offworld Percussion, Vancouver, WA (US)

( * ) Notice: Subject to any disclaimer, the term of this patent is extended or adjusted under 35 U.S.C. 154(b) by 0 days.

(21) Appl. No.: 12/508,474

(22) Filed: Jul. 23, 2009

Related U.S. Application Data

(60) Provisional application No. 61/135,911, filed on Jul. 25, 2008.

(51) Int. Cl.
*G10D 13/02* (2006.01)

(52) U.S. Cl. ..... 84/411 P

(58) Field of Classification Search ..... 84/411 P
See application file for complete search history.

(56) References Cited

U.S. PATENT DOCUMENTS

| | | | | | |
|---|---|---|---|---|---|
| 2,326,305 | A | | 8/1943 | Morarre | |
| 2,565,225 | A | | 8/1951 | Gladstone | |
| 3,105,406 | A | * | 10/1963 | Ippolito | 84/411 R |
| 3,264,926 | A | * | 8/1966 | Belli | 84/411 R |
| 3,597,520 | A | | 8/1971 | Andrews | |
| 4,179,974 | A | | 12/1979 | Trankle | |
| D255,035 | S | * | 5/1980 | North | D17/22 |
| 4,406,207 | A | | 9/1983 | Criscione | |
| 4,581,973 | A | * | 4/1986 | Hoshino | 84/723 |
| 4,589,323 | A | * | 5/1986 | Belli et al. | 84/411 R |
| 4,648,302 | A | * | 3/1987 | Bozzio | 84/730 |
| D319,650 | S | * | 9/1991 | Hart | D17/22 |
| 5,585,581 | A | * | 12/1996 | Rogers | 84/414 |
| 5,932,823 | A | * | 8/1999 | Jacobs | 84/411 P |
| 6,031,176 | A | * | 2/2000 | Tanaka | 84/735 |
| 6,239,340 | B1 | | 5/2001 | Heuerman | |
| 6,362,407 | B1 | | 3/2002 | Dennis | |
| 6,828,494 | B2 | * | 12/2004 | Toda | 84/411 R |
| 7,074,994 | B2 | | 7/2006 | Belli | |
| 7,135,630 | B2 | * | 11/2006 | Maruhashi et al. | 84/411 P |
| 7,439,432 | B2 | * | 10/2008 | Hiraku | 84/414 |
| 7,462,770 | B2 | * | 12/2008 | Dunnett | 84/411 R |
| 7,498,500 | B2 | * | 3/2009 | Rogers | 84/411 P |
| 7,569,758 | B2 | * | 8/2009 | Harada et al. | 84/411 M |
| 7,638,701 | B2 | | 12/2009 | May | |
| 7,737,351 | B2 | * | 6/2010 | Suzuki | 84/411 R |
| 2002/0112593 | A1 | * | 8/2002 | Yanase | 84/411 P |
| 2004/0007117 | A1 | * | 1/2004 | Howard, Sr. | 84/327 |
| 2005/0211062 | A1 | * | 9/2005 | Hiraku | 84/414 |
| 2009/0229450 | A1 | * | 9/2009 | Hashimoto | 84/723 |

OTHER PUBLICATIONS

Website http://www.guitarcenter.com/Remo-Practice-Pad-100215288-i1137027.gc, date unknown, 3 pages.

* cited by examiner

*Primary Examiner* — Elvin G Enad
*Assistant Examiner* — Robert W Horn
(74) *Attorney, Agent, or Firm* — Michael R. Schacht; Schacht Law Office, Inc.

(57) ABSTRACT

A rim for a drum pad assembly comprises a rim member defining an inner portion, a rim portion, an outer portion, a transition portion, and an edge portion. The inner portion is connected to the rim portion. The rim portion is connected to the outer portion. The outer portion is connected to the transition portion. The transition portion is connected to the edge portion. The rim portion defines a rim surface. The inner portion, outer portion, and edge portion are angled with respect to a reference plane. The rim portion is substantially parallel to the reference plane.

20 Claims, 2 Drawing Sheets

PRACTICE DRUM PAD ASSEMBLY AND RIM THEREFOR

RELATED APPLICATIONS

This application claims priority of U.S. Provisional Patent Application Ser. No. 61/135,911 filed Jul. 25, 2008, the contents of which are incorporated herein by reference.

TECHNICAL FIELD

The present invention relates to percussion instruments and, more specifically, to drum pad assemblies to be used instead of or in conjunction with drums to practice drumming techniques at lower volume levels.

BACKGROUND OF THE INVENTION

Proficiency with musical instruments requires practice. During practice, it is often desirable to control the volume of the instrument to avoid disturbing others in the area. With certain acoustic instruments, volume control can be especially difficult, and attempts to control volume can affect both playing technique and tone. Various devices and methods are used to mute or otherwise reduce the volume of musical instruments during practice.

Percussion instruments such as drums and cymbals present significant problems of controlling volume during practice. Many percussion instruments are loud by nature, and attempting to play percussion instruments such as drums and cymbals quietly is typically ineffective at reducing noise and may require substantial changes in technique that reduce the effectiveness of the practice.

Accordingly, as with musical instruments in general, various devices and methods have been developed to facilitate practice with percussion instruments. For drums and cymbals, drum pads or practice pads are used instead of or in conjunction with the drum or cymbal. Practice pads are typically made of a resilient material that absorbs impacts instead of resonating when struck. During use, a practice pad is conventionally placed on a drum or on another support surface such as a drum stand, a table or desk top, or the user's lap.

SUMMARY OF THE INVENTION

The present invention may be embodied as a rim for a drum pad assembly comprises a rim member defining an inner portion, a rim portion, an outer portion, a transition portion, and an edge portion. The inner portion is connected to the rim portion. The rim portion is connected to the outer portion. The outer portion is connected to the transition portion. The transition portion is connected to the edge portion. The rim portion defines a rim surface. The inner portion, outer portion, and edge portion are angled with respect to a reference plane. The rim portion is substantially parallel to the reference plane.

The present invention may also be embodied as a drum pad assembly comprising a body and a rim. The body comprises a substrate member and first and second surface layers. The substrate member defines a first substrate surface, a second substrate surface, and an edge surface. The first surface layer defines a first surface, and the second surface layer defines a second surface. The rim defines an inner portion, a rim portion, an outer portion, and an edge portion, and the rim portion defines a rim surface. The rim is secured to the substrate member such that the edge portion of the rim member extends over the edge surface of the substrate member and the rim surface is substantially parallel to and spaced from the first surface. The first surface layer is secured to the first substrate surface within a pad cavity defined by the substrate member and the rim member. The second surface layer is secured to the second substrate surface. The drum pad assembly operates in a normal mode and an inverted mode. In the normal mode, the first surface defines a primary striking surface, the rim surface defines a secondary striking surface, and the second surface defines a primary support surface. In the inverted mode, the rim surface defines a secondary support surface and the second surface defines a tertiary striking surface.

The present invention may also be embodied as a method of forming a drum pad assembly comprising the following steps. A substrate member defining a first substrate surface, a second substrate surface, and an edge surface is provided. A rim defining an inner portion, a rim portion, an outer portion, and an edge portion is provided, where the rim portion defines a rim surface. The rim is secured to the substrate member such that the edge portion of the rim member extends over the edge surface of the substrate member and the rim surface is substantially parallel to and spaced from the first surface. The first surface layer is secured to the first substrate surface within a pad cavity defined by the substrate member and the rim member to define a first surface. The second surface layer is secured to the second substrate surface to define a second surface. The drum pad assembly in is operated in a normal mode and in an inverted mode. In the normal mode, the first surface defines a primary striking surface, the rim surface defines a secondary striking surface, and the second surface defines a primary support surface. In the inverted mode, the rim surface defines a secondary support surface and the second surface defines a tertiary striking surface.

DETAILED DESCRIPTION OF THE INVENTION

Figure 1:
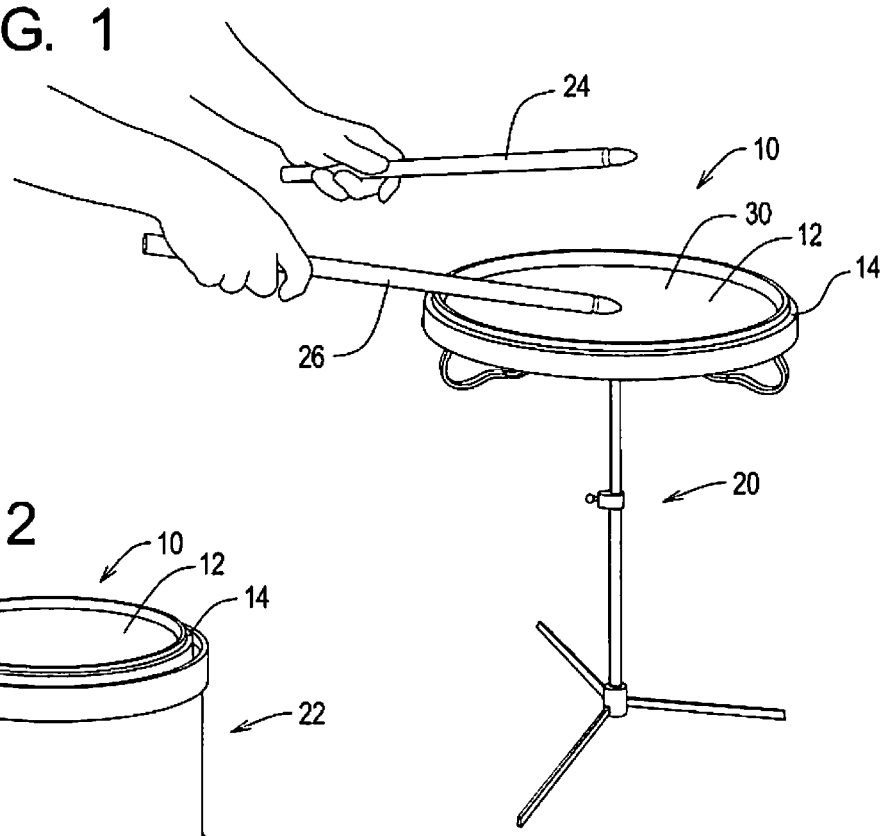
FIG. 1 is a perspective view of a first example practice pad of the present invention on a first type of support structure.

Referring initially to FIG. 1 of the drawing, depicted therein is a first example drum pad assembly 10 constructed in accordance with, and embodying, the principles of the present invention. The example drum pad assembly 10 comprises a body 12 and a rim 14.

Figure 2:
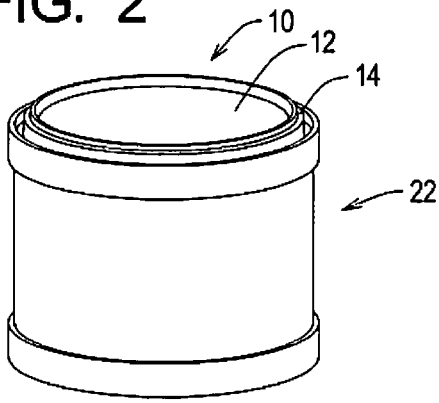
FIG. 2 is a perspective view of a first example practice pad of the present invention on a second type of support structure.

The drum pad assembly 10 is arranged on a support structure such as a drum stand 20 (FIG. 1), a drum 22 (FIG. 2), or another structure such as a table or even the drummer's lap. The drum pad assembly 10 is struck using first and second drumsticks 24 and 26 in a conventional manner as will be described in further detail below.

The body 12 of the first example drum pad assembly 10 defines a first surface 30 and a second surface 32. The rim 14 of the first example drum pad assembly 10 defines a rim surface 34 and an outer surface 36.

In a normal mode, the first surface 30 forms a primary striking surface, the rim surface 34 forms a secondary striking surface, and the second surface 32 forms a primary support surface. In the normal mode, the second surface 32 engages the support structure, and the first surface 30 and rim surface 32 are easily accessible to the drummer. In the normal mode, the first example drum pad assembly 10 may be used in a manner similar to that of a snare drum. A snare drum comprises a drum head and a rim, with the rim being raised slightly from the drum head. When playing a snare drum, the drummer most often strikes the head of the snare drum, but will sometimes strike the rim of the snare drum. During use of the first example drum pad assembly 10 in the normal mode, the drummer strikes the first surface 30 in a manner similar to that of striking the head of a snare drum and strikes the rim surface 34 in a manner similar that of striking the rim of a snare drum.

In an inverted mode, the second surface 32 forms a tertiary striking surface, and the rim surface 34 forms a secondary support surface. In this inverted mode, the rim surface 34 engages the support structure, and the second surface 32 is easily available to the drummer. In the inverted mode, the first example drum pad assembly 10 may be used in a manner similar to that of drums that do not have a raised rim. When playing drums without a raised rim, the drummer almost exclusively strikes the head of the drum. During use of the first example drum pad assembly 10 in the inverted mode, the drummer strikes the second surface 32 in a manner similar to that of striking the head of a drum without a raised rim.

Figure 3:
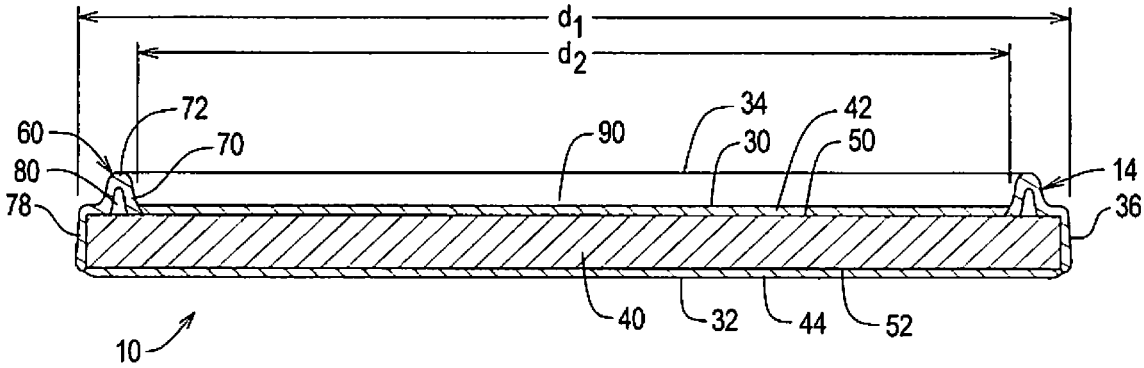
FIG. 3 is a section view of the first example practice pad depicted in FIGS. 1 and 2.
Figure 4A:
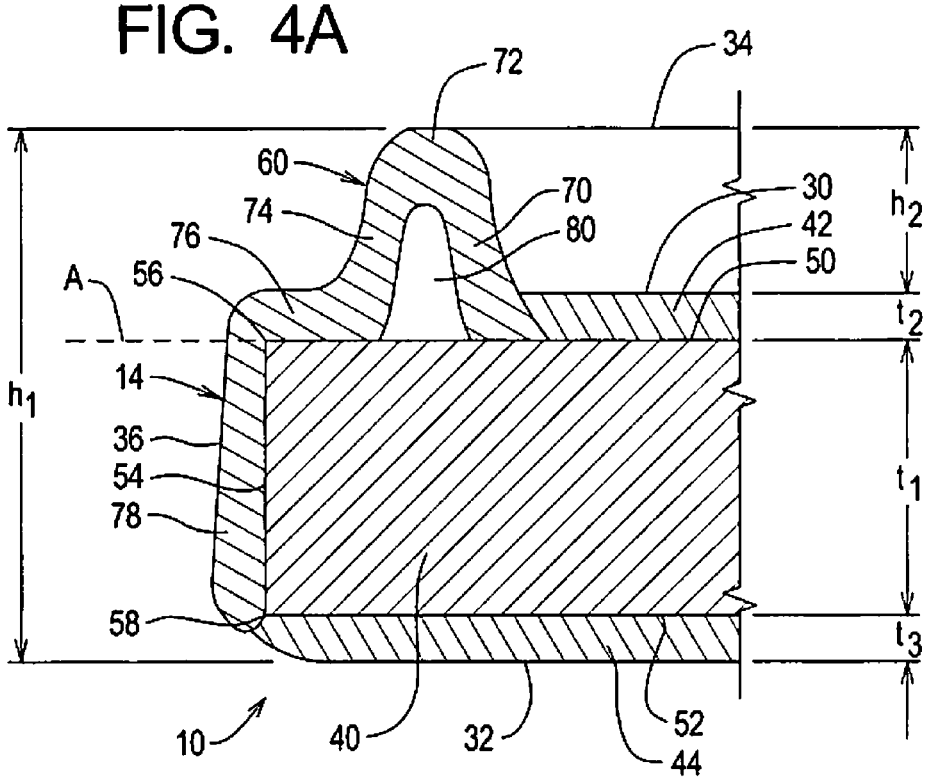
FIG. 4A is an enlarged section view of a portion of FIG. 3 illustrating details of construction of the first example practice pad.

Turning now to FIGS. 3 and 4A of the drawing, the details of construction of the first example drum pad assembly 10 will now be described in further detail. As shown in FIG. 3, the body 12 of the first example drum pad assembly 10 comprises a substrate member 40, a first surface layer 42, and a second surface layer 44. The substrate member 40 takes the form of a flat disc defining first and second substrate surfaces 50 and 52 and an edge surface 54. The first and second substrate surfaces 50 and 52 are substantially flat and substantially parallel with each other, and the edge surface 54 is cylinder-shaped and substantially perpendicular to the first and second substrate surfaces 50 and 52. First and second corners 56 and 58 are formed between the edge surface 54 and the first and second substrate surfaces 50 and 52, respectively.

The example rim 14 of the first example drum pad assembly 10 comprises a rim member 60. The rim member 60 is generally circular in shape and defines an inner portion 70, a rim portion 72, an outer portion 74, a transition portion 76, and an edge portion 78. The inner portion 70 is connected to the rim portion 72, and the rim portion 72 is in turn connected to the outer portion 74. The outer portion 74 is connected to the transition portion 76, and the transition portion 76 is connected to the edge portion 78.

The rim 14 extends around the perimeter of the body 12 such that the edge portion 78 of the rim member 60 overlays the edge surface 54 of the substrate member 40 and the inner portion 70, rim portion 72, and outer portion 74 of the rim member 60 overlay a portion of the first substrate surface 50 of the substrate member 40.

With the rim member 60 extending around the perimeter of the body 12, the inner portion 70, outer portion 74, and edge portion 78 extend at an angle with respect to a reference plane A defined by the first substrate surface 50, while the rim portion 72 and the transition portion 76 are substantially parallel to the reference plane A. The transition portion 76 of the rim member 60 further defines a corner that connects the outer portion 74 and the edge portion 78.

As perhaps best shown in FIG. 3, the first surface layer 42 extends over the entire first substrate surface 50 of the substrate member 40 within the inner portion 70 of the rim member 60. FIG. 3 also shows that the second surface layer 44 extends over the entire second substrate surface 52 of the substrate member 40 and to the edge portion 78 of the rim member 60.

FIGS. 3 and 4A illustrate that the example substrate member 40 and rim member 60 define a rim cavity 80; in particular, the rim cavity 80 is a void formed between the inner and outer portions 70 and 74 of the rim member 60 and between the rim portion 72 and first substrate surface 50 of the substrate member 40.

The first example drum pad assembly 10 may be formed using the following method. The substrate member 40 is formed as a circular shape with a first diameter. The rim member 60 is formed such that the edge portion 78 thereof defines a second diameter. The first and second diameters are predetermined such that the edge surface 54 of the substrate member 40 snugly fits within the edge portion 78 of the rim member 60.

The first and second surface layers 42 and 44 are next formed. In the first example drum pad assembly 10, the first and second surface layers 42 and 44 may be formed by pouring a hardenable liquid surface material onto the first and second substrate surfaces 50 and 52 defined by the substrate member 40. When the liquid surface material hardens, the surface material bonds to the first and second substrate surfaces 50 and 52 to form the first and second surface layers 42 and 44, respectively. Alternatively, the first and second layers 42 and 44 may be formed by cutting flat stock into an appropriate shape and adhering the cut flat stock to the substrate surfaces 50 and 52.

As shown in FIGS. 3 and 4A, the first surface layer 42 is arranged on top of the first substrate surface 50 within the inner portion 70 of the rim member 60. As described above, the rim member inner portion 70 overlays a portion of the first substrate surface 50 adjacent to the edge surface 54, while the edge portion 78 of the rim member 60 does not overlay the second substrate surface 52. Accordingly, a diameter of the first surface layer 42 is slightly smaller than a diameter of the second surface layer 44 because of the size and dimension of the rim member 60 relative to the substrate member 40.

The substrate member 40 provides the main structural integrity of the first example drum pad assembly 10. The material from which the substrate member 40 is made thus should be sufficiently rigid to maintain the first and second surface layers 42 and 44 in a substantially planar shape during use. The substrate member 40 further provides most of the weight of the drum pad assembly 10. The material from which the substrate member 40 is made should thus have sufficient mass to maintain the drum pad assembly 10 in a desired location during playing but not be so heavy as to be uncomfortable for the drummer during use.

The Applicant has determined that medium density fiberboard (MDF) is appropriate for use as the substrate member 40, but other materials, such as other fiberboards, plywood, metal, plastics, or composites, can be used to form the substrate member 40. The composition and density of the substrate member 40 affects the pitch/tonality of the drum pad assembly 10: a higher density material yields a higher perceived pitch/tonality of the assembly 10 when struck. In addition, a material having lower density yields higher vibration transmission through the assembly 10. The density of the material forming the substrate member 40 should be selected to obtain a desirable pitch and tonality and such that the transmission of vibrations through the drum pad assembly 10 are acceptable.

The material from which the first and second surface layers 42 and 44 are made defines the striking and rebound characteristics of the first and second surfaces 30 and 32 of the drum pad assembly 10. These surface layers 42 and 44 are also repeatedly struck with the drum sticks 24 and 26, so the material forming these surface layers 42 and 44 should sufficiently durable to achieve an acceptable wear life of the drum pad assembly 10. The first example drum pad assembly 10 uses polyurethane to form the example surface layers 42 and 44.

The polyurethane formulation used to form the example surface layers 42 and 44 is heated to a temperature of in a range of approximately 250-300° F. and allowed to cure under ambient conditions. The polyurethane formulation used to form the example layers 42 and 44 has a Shore A durometer rating of approximately 45 and is approximately ⅛ of an inch in thickness. In any event, the polyurethane formulation should have a durometer rating of substantially between 38 and 52 and a thickness of substantially between 3/32 and 3/16 of an inch. This combination of material, density, and depth approximates the rebound characteristics of a properly tuned snare drum head and thereby minimizes playing differences between a snare drum and the example drum pad assembly 10.

Alternatively, other polyurethane formulations, gum rubber, silicone, polypropylene, neoprene, open-cell sponge rubber, or other materials with desirable or comparable striking, rebound, and wear characteristics may be used. To approximate the rebound characteristics of a particular drum, such as a properly tuned snare drum head, the durometer, density, and thickness of the material may be selected as appropriate to mimic that particular drum.

Although the first example drum pad assembly 10 uses the same material to form both the first surface layer 42 and the second surface layer 44, different materials may be used for these surface layers 42 and 44. Alternatively, the second example drum pad assembly 10 may be made with only one surface layer (typically the first surface layer 42). A drum pad assembly with only one surface layer effectively operates only in either the normal mode or the inverted mode and not both modes as described above.

The example rim member 60 defines the striking and rebound characteristics of the rim surface 34 of the drum pad assembly 10. The material forming the rim member 60 thus should also be sufficiently stable to achieve an acceptable wear life of the drum pad assembly 10. The first example drum pad assembly 10 may be made of nylon, acrylonitrile butadiene styrene (ABS), polyvinyl chloride (PVC), or any equivalent material or combination of materials. Alternatively, any material with similar striking, rebound, and wear characteristics may be used to form the rim member 60.

The first example drum pad assembly 10 is formed as follows. Initially, the substrate member 40 is formed by cutting a circular piece from a flat stock of MDF material. The rim member 60 is formed by injection molding a suitable material into a mold defining the shape of the rim member 60 as defined above.

An adhesive is then applied to one or both of the edge portion 78 of the rim member 60 and the edge surface 54 of the substrate member 40, and the substrate member 40 is displaced such that that edge portion 78 of the rim member 60 encircles the edge surface 54 with the inner portion 70 in contact with the first substrate surface 50. The adhesive is allowed to harden to bond the rim member 60 to the substrate member 40. The adhesive is selected to have good bonding properties with both the material forming the substrate member 40 and the rim member 60. Alternatively or in addition, the rim member 60 is configured to mechanically engage the substrate member 40 (e.g., textured to increase friction; projection/groove) to secure the rim member 60 in place around the substrate member 40.

The first and second surface layers 42 and 44 are next provided. When the rim member 60 is attached to the substrate member 40, the inner portion 70 of the rim member 60 and the first substrate surface 50 of the substrate member 40 form a shallow pad cavity 90. In the first example drum pad assembly 10, the first and second surface layers 42 and 44 may be formed by pouring a hardenable liquid surface material as generally described onto the first and second substrate surfaces 50 and 52 defined by the substrate member 40. When the liquid surface material hardens, it bonds to the first and second substrate surfaces 50 and 52 to form the first and second surface layers 42 and 44, respectively. Optionally, pressure may be applied to the liquid surface material as it hardens.

Alternatively, the first and second layers 42 and 44 may be formed by cutting or molding flat stock made of solid surface material into an appropriate shape. Adhesive is then applied to the first and second layers 42 and 44 and/or the substrate surfaces 50 and 52 and the first and second layers 42 and 44 placed onto the substrate surfaces 50 and 52 to adhere the surface layers 42 and 44 to the substrate surfaces 50 and 52, respectively.

The example first drum pad assembly 10 has a diameter $d_1$ of 13.75 inches and a height $h_1$ of 1.75 inches. The example substrate layer 40 has a thickness $t_1$ of 0.75 inches, and thicknesses $t_2$ and $t_3$ of the first and second surface layers 42 and 44 are approximately 0.25 inches. The example first layer 42 has a diameter $d_2$ of approximately 12 inches. The rim surface 34 defined by the rim member 60 of the first example pad assembly 10 extends a height $h_2$ of approximately 0.5 inches above the first surface 30. A drum pad assembly constructed in accordance with the principles of the present invention can be made in shapes and sizes other than those associated with the example first drum pad assembly 10, but the example pad assembly 10 is sized and dimensioned to fit easily onto the drum head of a standard snare drum.

Figure 4B:
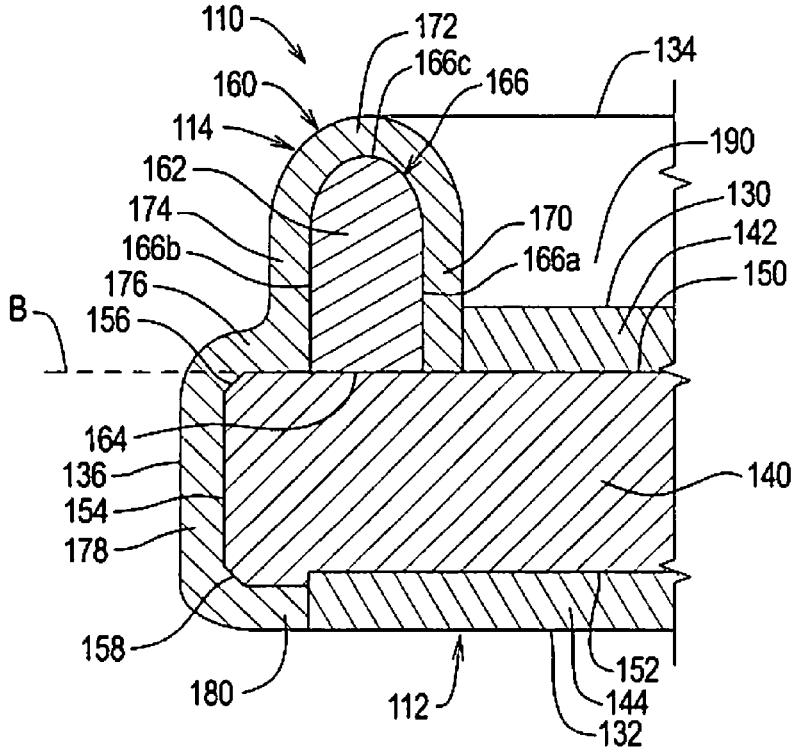
FIG. 4B is an enlarged section view similar to FIG. 4A of a portion of a second example practice pad of the present invention.

Turning now to FIG. 4B, depicted therein is a second example drum pad assembly 110 constructed in accordance with, and embodying, the principles of the present invention. The example drum pad assembly 110 comprises a body 112 and a rim 114. Like the first example drum pad assembly 10, the drum pad assembly 110 is adapted to be arranged on a support structure and is struck using drumsticks in a conventional manner.

The second example drum pad assembly is constructed and used in a manner similar to that of the first example drum pad assembly 10; accordingly, the second example drum pad assembly 110 will be described and depicted herein only to the extent that the second example drum pad assembly 110 differs from the first example drum pad assembly 10.

The body 112 of the second example drum pad assembly 110 defines a first surface 130 and a second surface 132. The rim 114 of the second example drum pad assembly 110 defines a rim surface 134 and an edge surface 136.

In a normal mode, the first surface 130 forms a primary striking surface, the rim surface 134 forms a secondary striking surface, and the second surface 132 forms a primary support surface. In the normal mode, the second surface 132 engages the support structure, and the first surface 130 and rim surface 132 are easily accessible to the drummer. In the normal mode, the second example drum pad assembly 110 may be used in a manner similar to that of a snare drum.

In an inverted mode, the second surface 132 forms a tertiary striking surface, and the rim surface 134 forms a secondary support surface. In this inverted mode, the rim surface 134 engages the support structure, and the second surface 132 is easily available to the drummer. In the inverted mode, the second example drum pad assembly 110 may be used in a manner similar to that of drums that do not have a raised rim.

The body 112 of the second example drum pad assembly 110 comprises a substrate member 140, a first surface layer 142, and a second surface layer 144. The substrate member 140 takes the form of a flat disc defining first and second substrate surfaces 150 and 152 and an edge surface 154. The first and second substrate surfaces 150 and 152 are substantially flat and substantially parallel with each other, and the edge surface 154 is cylinder-shaped and substantially perpendicular to the first and second substrate surfaces 150 and 152. First and second corners 156 and 158 are formed between the edge surface 154 and the first and second substrate surfaces 150 and 152, respectively.

The example rim 114 of the second example drum pad assembly 110 comprises a rim member 160 and a rim base 162. The rim member 160 is a generally circular thin layer formed over the rim base 162 and around the perimeter of the substrate member 140. The rim base 162 is generally circular and defines an inner surface 164 and an outer surface 166. The inner surface 164 is flat, while the outer surface 166 comprises first and second flat side portions 166*a* and 166*b* and a rounded portion 166*c*.

The rim member 160 defines an inner portion 170, a rim portion 172, an outer portion 174, a transition portion 176, an edge portion 178, and a return portion 180. The inner portion 170 is connected to the rim portion 172, and the rim portion 172 is in turn connected to the outer portion 174. The outer portion 174 is connected to the transition portion 176, and the transition portion 176 is connected to the edge portion 178. The edge portion is connected to the return portion 180.

The rim 114 extends around the perimeter of the body 112 such that the rim member inner surface 164 engages the first substrate surface 150 adjacent to the edge surface 154. The rim member 160 extends over the edge surface 154 of the substrate member 140 and the rim member 162. More specifically, the inner portion 170, rim portion 172, and outer portion 174 of the rim member 160 extends over a portion of the first substrate surface 150 of the substrate member 140 and over the rim member outer surface 166.

With the rim member 160 extending around the perimeter of the body 112, the inner portion 170, outer portion 174, and edge portion 178 extend at an angle with respect to a reference plane B defined by the substrate surface 150, while the rim portion 172 and the transition portion 176 are substantially parallel to the reference plane B. The transition portion 176 of the rim member 160 further extends over the first corner 156 of the body 112 to connect the edge portion 178 and the outer portion 174. The return portion 180 of the rim member 160 extends a short distance back along the second substrate surface 152.

The first surface layer 142 extends over the entire first substrate surface 150 of the substrate member 140 within the inner portion 170 of the rim member 160. The second surface layer 144 extends over the entire second substrate surface 152 of the substrate member 140 and to the return portion 180 of the rim member 160. FIG. 4B illustrates that the example rim base 162 is snugly held between the substrate member 140 and the rim member 160.

The second example drum pad assembly 110 may be formed using the following method. The substrate member 140 is formed as a circular shape with a first diameter. The rim base 162 is formed to define a second diameter. The rim base 162 and the rim member 160 are combined to define the rim 114. With the centers of the substrate member 140 and the rim base 162 aligned, the return portion 180 of the rim member 160 extends around the edge surface 154 of the substrate member 140 to attach the rim 114 to the substrate member 140. With the rim 114 attached to the substrate member 140, the rim base 162 extends around the substrate member 140 and is spaced a short distance from the edge surface 154.

The first and second surface layers 142 and 144 are next formed. In the second example drum pad assembly 110, the first and second surface layers 142 and 144 may be formed by pouring a hardenable liquid surface material onto the first and second substrate surfaces 150 and 152 defined by the substrate member 140. When the liquid surface material hardens, the surface material bonds to the first and second substrate surfaces 150 and 152 to form the first and second surface layers 142 and 144, respectively. Alternatively, the first and second layers 142 and 144 may be formed by cutting flat stock into an appropriate shape and adhering the cut flat stock to the substrate surfaces 150 and 152.

As shown in FIG. 4B, the first surface layer 142 is arranged on top of the first substrate surface 150 within the inner portion 170 of the rim member 160. As described above, the rim member inner portion 170 overlays a portion of the first substrate surface 150 adjacent to the edge surface 154, while the return portion 180 of the rim member 160 overlays a portion of the second substrate surface 152. Accordingly, a diameter of the first surface layer 142 is slightly smaller than a diameter of the second surface layer 144 because of the size and dimension of the rim member 160 relative to the substrate member 140.

The substrate member 140 provides the main structural integrity of the second example drum pad assembly 110. The material from which the substrate member 140 is made thus should be sufficiently rigid to maintain the first and second surface layers 142 and 144 in a substantially planar shape during use. The substrate member 140 further provides most of the weight of the drum pad assembly 110. The material from which the substrate member 140 is made should thus have sufficient mass to maintain the drum pad assembly 110 in a desired location during playing but not be so heavy as to be uncomfortable for the drummer during use.

The Applicant has determined that medium density fiberboard (MDF) is appropriate for use as the substrate member 140, but other materials, such as other fiberboards, plywood, metal, plastics, or composites, can be used to form the substrate member 140. The composition and density of the substrate member 140 affects the pitch/tonality of the drum pad assembly 110: a higher density material yields a higher perceived pitch/tonality of the assembly 110 when struck. In addition, a material having lower density yields higher vibration transmission through the assembly 110. The density of the material forming the substrate member 140 should be selected to obtain a desirable pitch and tonality and such that the transmission of vibrations through the drum pad assembly 110 are acceptable.

The material from which the first and second surface layers 142 and 144 are made defines the striking and rebound characteristics of the first and second surfaces 130 and 132 of the drum pad assembly 110. These surface layers 142 and 144 are also repeatedly struck with the drum sticks, so the material forming these surface layers 142 and 144 should sufficiently durable to achieve an acceptable wear life of the drum pad assembly 110.

The second example drum pad assembly 110 uses polyurethane to form the example surface layers 142 and 144.

The polyurethane formulation used to form the example surface layers 142 and 144 is heated to a temperature of in a range of approximately 250-300° F. and allowed to cure under ambient conditions. The polyurethane formulation used to form the example layers 142 and 144 has a Shore A durometer rating of approximately 45 and is approximately ⅛ of an inch in thickness. In any event, the polyurethane formulation should have a durometer rating of substantially between 38 and 52 and a thickness of substantially between 3/32 and 3/16 of an inch. This combination of material, density, and depth approximates the rebound characteristics of a properly tuned snare drum head and thereby minimizes playing differences between a snare drum and the example drum pad assembly 110.

Alternatively, other polyurethane formulations, gum rubber, silicone, polypropylene, neoprene, open-cell sponge rubber, or other materials with desirable or comparable striking, rebound, and wear characteristics may be used. To approximate the rebound characteristics of a particular drum, such as a properly tuned snare drum head, the durometer, density, and thickness of the material may be selected as appropriate to mimic that particular drum.

Although the second example drum pad assembly 110 uses the same material to form both the first surface layer 142 and the second surface layer 144, different materials may be used for these surface layers 142 and 144. Alternatively, the second example drum pad assembly 110 may be made with only one surface layer (typically the first surface layer 142). A drum pad assembly with only one surface layer effectively operates only in either the normal mode or the inverted mode and not both modes as described above.

The example rim member 160 and rim base 162 define the striking and rebound characteristics of the rim surface 134 of the drum pad assembly 110. The materials forming the rim member and rim base 162 thus should also be sufficiently stable to achieve an acceptable wear life of the drum pad assembly 110. The second example drum pad assembly 110 my be made of nylon, acrylonitrile butadiene styrene (ABS), polyvinyl chloride (PVC), or any equivalent material or combination of materials. Alternatively, any material with similar striking, rebound, and wear characteristics may be used to form the rim member 160.

The second example drum pad assembly 110 is formed as follows. Initially, the substrate member 140 is formed by cutting a circular piece from a flat stock of MDF material. The rim member 160 is formed by injection molding a suitable material into a mold defining the shape of the rim member 160 as defined above.

The rim 114 is then formed by securing the rim member 160 to the rim base 162. The rim member 160 may be secured to the rim base 162 by applying adhesive to the rim member 160 and/or the base surface 166 or by friction fit or the like. An adhesive is then applied to at least one of the edge portion 178 of the rim member 160, the edge surface 154 of the substrate member 140, and the surface 164 of the rim base 162, and the substrate member 140 is displaced such that that edge portion 178 of the rim member 160 encircles the edge surface 154 with the inner portion 170 in contact with the first substrate surface 150. The adhesive is allowed to harden to bond the rim member 160 to the substrate member 140. The adhesive is selected to have good bonding properties with both the material forming the substrate member 140 and the rim member 160. Alternatively or in addition, the rim member 160 configured to mechanically engage the substrate member 140 (e.g., textured to increase friction; projection extends into a recess) to secure the rim member 160 in place around the substrate member 140.

The first and second surface layers 142 and 144 are next provided. When the rim member 160 is attached to the substrate member 140, the inner portion 170 of the rim member 160 and the first substrate surface 150 of the substrate member 140 form a shallow pad cavity 190. In the second example drum pad assembly 110, the first and second surface layers 142 and 144 may be formed by pouring a hardenable liquid surface material onto the first and second substrate surfaces 150 and 152 defined by the substrate member 140. When the liquid surface material hardens, it bonds to the first and second substrate surfaces 150 and 152 to form the first and second surface layers 142 and 144, respectively. Optionally, pressure may be applied to the liquid surface material as it hardens.

Alternatively, the first and second layers 142 and 144 may be formed by cutting or molding flat stock made of solid surface material into an appropriate shape. Adhesive is then applied to the first and second layers 142 and 144 and/or the substrate surfaces 150 and 152 and the first and second layers 142 and 144 placed onto the substrate surfaces 150 and 152 to adhere the surface layers 142 and 144 to the substrate surfaces 150 and 152, respectively.

The dimensions of the second example drum pad assembly 110 may be the same as those of the second example drum pad assembly 10 as described above. A drum pad assembly constructed in accordance with the principles of the present invention can be made in shapes and sizes other than those associated with the example first drum pad assembly 110, but the example pad assembly 110 is sized and dimensioned to fit easily onto the drum head of a standard snare drum.

The present invention may be implemented in configurations other than described herein. The scope of the present invention should thus be determined by the claims appended hereto and not the foregoing detailed description of several examples of the present invention.

What is claimed is:

1. A drum pad assembly comprising:

a body comprising a substrate member defining a first substrate surface, a second substrate surface, and an edge surface, and a first surface layer defining a first surface;

a rim defining an inner portion, a rim portion, an outer portion, and an edge portion, where the rim portion defines a rim surface; wherein the rim is secured to the substrate member such that the edge portion of the rim member extends over the edge surface of the substrate member, and the rim surface is substantially parallel to and spaced from the first surface;

the first surface layer is secured to the first substrate surface within a pad cavity defined by the substrate member and the rim member; and the drum pad assembly operates in a normal mode in which the first surface defines a primary striking surface, the rim surface defines a secondary striking surface, and the second surface defines a primary support surface, and an inverted mode in which the rim surface defines a secondary support surface and the second surface defines a tertiary striking surface.

2. A drum pad assembly as recited in claim 1, further comprising a second surface layer defining a second surface, where the second surface layer is secured to the second substrate surface.

3. A drum pad assembly as recited in claim 1, in which the inner portion, rim portion, transition portion, and first substrate surface define a rim cavity.

4. A drum pad assembly as recited in claim 1, in which the rim further comprises a rim base, where the inner portion, the rim portion, and the outer portion extend over an outer surface of the rim base.

5. A drum pad assembly as recited in claim 1, in which the rim further comprises a return portion, where the rim portion is connected to the return portion.

6. A drum pad assembly as recited in claim 4, in which the rim further comprises a return portion, where the rim portion is connected to the return portion.

7. A drum pad assembly as recited in claim 1, where the rim is injection molded.

8. A drum pad assembly as recited in claim 1, where the rim is formed of at least one of nylon, acrylonitrile butadiene styrene (ABS), polyvinyl chloride (PVC), and any equivalent material.

9. A drum pad assembly as recited in claim 1, where the substrate member is formed of fiberboard, plywood, metal, plastic, or composite.

10. A drum pad assembly as recited in claim 1, where the first layer is formed of at least one of polyurethane, gum rubber, and silicone.

11. A drum pad assembly as recited in claim 1, where the first layer is formed of material having a durometer of substantially between 38 and 52.

12. A drum pad assembly as recited in claim 1, where the first layer is formed of material having a thickness of substantially between 3/32 of an inch and 3/16 of an inch.

13. A drum pad assembly as recited in claim 1, further comprising a rim cavity defined by the rim and the body.

14. A drum pad assembly as recited in claim 1, in which the step of securing the rim to the substrate member further comprises the step of forming a rim cavity.

15. A method of forming a drum pad assembly comprising the steps of:

providing a substrate member defining a first substrate surface, a second substrate surface, and an edge surface;

providing a rim defining an inner portion, a rim portion, an outer portion, and an edge portion, where the rim portion defines a rim surface;

securing the rim to the substrate member such that the edge portion of the rim member extends over the edge surface of the substrate member, and the rim surface is substantially parallel to and spaced from the first surface;

securing a first surface layer to the first substrate surface within a pad cavity defined by the substrate member and the rim member to define a first surface;

securing the second surface layer to the second substrate surface to define a second surface;

operating the drum pad assembly in a normal mode in which the first surface defines a primary striking surface, the rim surface defines a secondary striking surface, and the second surface defines a primary support surface, and an inverted mode in which the rim surface defines a secondary support surface and the second surface defines a tertiary striking surface.

16. A method as recited in claim 15, in which the step of providing the rim comprises the step of injection molding at least one selected from acrylonitrile butadiene styrene (ABS), polyvinyl chloride (PVC), and any equivalent material.

17. A method as recited in claim 15, where the step of providing the substrate member comprises the step of forming the substrate member of fiberboard, plywood, metal, plastic, or composite.

18. A method as recited in claim 15, where the steps of securing the first and second layers comprises the step of forming the first and second layers of at least one of polyurethane, gum rubber, and silicone.

19. A method as recited in claim 15, where the step of securing the first layer to the first substrate surface comprises the step of providing material having a durometer of substantially between 38 and 52.

20. A method as recited in claim 15, where the step of securing the first layer to the first substrate surface comprises the step of providing material having a thickness of substantially between 3/32 of an inch and 3/16 of an inch.

* * * * *